US005908252A

United States Patent [19]

Harada et al.

[11] Patent Number: 5,908,252

[45] **Date of Patent: *Jun. 1, 1999**

[54] THERMAL PRINTING INK RIBBON

[75] Inventors: Toshimichi Harada; Satoru Sugita; Tetsuya Abe, all of Tochigi, Japan

[73] Assignee: Sony Chemicals Corp., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/964,910

[22] Filed: Nov. 5, 1997

[30] Foreign Application Priority Data

Nov. 6, 1996 [JP] Japan ..... 8-293474

[51] Int. Cl.[6] ..... B41J 31/09

[52] U.S. Cl. ..... 400/237; 428/195; 428/913

[58] Field of Search ..... 428/195, 206, 428/204, 207, 209, 913; 400/237

[56] References Cited

U.S. PATENT DOCUMENTS

| | | | |
|---|---|---|---|
| 4,027,345 | 6/1977 | Fujisawa et al. | 8/2.5 R |
| 4,536,434 | 8/1985 | Magnotta | 428/200 |
| 4,548,857 | 10/1985 | Galante | 428/200 |
| 4,555,436 | 11/1985 | Geurtsen et al. | 428/200 |
| 5,279,889 | 1/1994 | MacCollum | 428/212 |
| 5,589,434 | 12/1996 | Takahara et al. | 503/227 |

FOREIGN PATENT DOCUMENTS

| | | |
|---|---|---|
| A 61-78692 | 4/1986 | Japan . |
| A 2-589 | 1/1990 | Japan . |
| A 4-78585 | 3/1992 | Japan . |

*Primary Examiner*—Edgar Burr
*Assistant Examiner*—Dave A. Ghatt
*Attorney, Agent, or Firm*—Hill & Simpson

[57] ABSTRACT

A new and improved thermal printing ink ribbon includes a heat-resistant base, a release layer disposed on the base including an ester wax and a rubber copolymer containing a specified aromatic monomer content and an ink layer disposed on the release layer by a solvent or hot-solvent process. The thermal printing ink ribbons exhibit satisfactory transferability even during high speed printing or after high temperature storage. The thermal printing ink ribbons are well suited for use in end face head-type printers.

20 Claims, 2 Drawing Sheets

THERMAL PRINTING INK RIBBON

BACKGROUND OF THE INVENTION

1. Field of the Invention

The present invention relates to so-called thermal printing ink ribbons for printing character and/or bar code images on substrates such as labels, and more specifically thermal printing ink ribbons which are excellent in transferability of the ink layer.

2. Prior Art

In recent years, it is common to control prices and sales information of commercial products by means of a bar code image printed on the package or a label attached to each product.

Thermal printing ink ribbons have long been used as means for printing such a bar code image.

These thermal printing ink ribbons comprise an ink layer consisting of a colorant and a binder material such as wax on a heat-resistant base, and may be fitted to a printer so that the ink layer is molten under heat of the thermal head and transferred onto packaging paper or a label to give a desired thermal bar code image thereon.

Common means for forming the ink layer on the base includes the so-called hot-melt process involving melting an ink layer composition under heat into liquid and applying the ink liquid on a base; or the so-called solvent process involving dissolving an ink layer composition in an organic solvent such as toluene to prepare a solution and applying the ink solution on a base; or the so-called hot solvent process involving dissolving an ink layer composition under heat in an organic solvent such as toluene to prepare a solution and applying the ink solution as heated on a base.

Recently, there are growing demands for improving the transferability of such thermal printing ink ribbons or the durability of the bar code images printed. As means to meet these demands, an ink ribbon provided with a release layer comprising a predominant amount of wax between a base and an ink layer (JPA No. 78692/86) or an ink ribbon provided with a release layer comprising a predominant amount of wax with a small amount of rubber (JPA Nos. 2-589 and 78585/92) have been widely known.

The release layer comprising a predominant amount of wax is readily molten under heat and transferred with an ink layer, and therefore it can be expected to improve the durability and transferability.

The release layer including a small amount of rubber can be expected to not only improve the transferability and durability but also prevent the ink layer from slipping off. On the other hand, there is a demand for printers to operate at high printing speed in order to increase the efficiency of printing operation. In order to meet this demand, so-called end face head-type printers have recently drawn interest wherein a heat generating element 100 of a thermal head fitted to the printer is formed at the front end of the head substrate 101 in the moving direction of an ink ribbon 102, as shown in FIG. 3.

This printer is expected to improve the transferability of the ink layer even at high printing speed because of the greater angle θ at which the ink ribbon 102 is separated from a substrate 103 such as a label compared with prior printers when the ink layer is in hot-molten state with a low cohesive force.

However, any thermal printing ink ribbon even provided with the above mentioned release layer could not give satisfactory transferability or other performances of the ink layer for practical use at high printer speed. In particular, the transferability has scarcely been improved with ink ribbons prepared by applying an ink layer by the solvent process or hot-solvent process.

The transferability of the ink layer of these ink ribbons was further lowered after they were stored in high-temperature environment.

The inventors investigated the cause of the above problems and found that they were associated with the coating process, i.e. the process of applying the ink solution on the base.

Namely, if the solvent process or hot-solvent process is used to form an ink layer on a release layer, the release layer is formed as a mixture with the ink layer because it is dissolved or dissolved under heat in the solvent in the ink solution. Thus, the boundary between the release layer and the ink layer becomes unclear, and the release layer is formed in a thickness much smaller than intended. As a result, the transferability of the ink layer is not improved.

In order to lower the extent to which the ink layer and the release layer mix with each other, a possible approach is to modify preparation conditions, particularly by lowering the temperature of the ink solution during coating in the hot-solvent process or lowering the temperature of the drying oven during evaporation of the solvent to drying in the solvent process or hot-solvent process.

However, these approaches invite coating failure due to the increase in viscosity or decrease in solubility of the ink solution or drying failure, thus considerably reduce the productivity.

The problem that the transferability of the ink layer is lowered after storage in high-temperature environment was also associated with the fact that the release layer and the ink layer mix with each other under environmental heat.

Particularly when the release layer and the thermally meltable ink layer contain the same type of wax, both are liable to mix with each other.

In order to lower here the extent to which the ink layer and the release layer mix with each other, a possible approach is a combination of different types of waxes in the release layer and the ink layer.

However, it is difficult to improve the transferability with a combination of different types of waxes of different heats of fusion or different components, because the release layer and the ink layer are required to be transferred together. Further, a coating failure such as pinhole may occur with a combination of different types of waxes due to the difference in polarity.

Accordingly, a first object of the present invention is to provide a thermal printing ink ribbon clearly defining a boundary between the release layer and the ink layer during the coating process to ensure a good transferability even at high printing speed.

A second object of the present invention is to provide a thermal printing ink ribbon wherein the transferability is not lowered even if it is stored in high-temperature environment.

A third object of the present invention is to provide a thermal printing ink ribbon which can be suitably used even with end face head-type printers.

SUMMARY OF THE INVENTION

In order to attain the above objects, the present invention provides a thermal printing ink ribbon comprising: a release layer including a rubber copolymer comprising units derived from aromatic monomers and units derived from other monomers and an ester wax on one face of a heat-resistant base; and a thermally meltable ink layer formed on said release layer by the solvent process or hot-solvent process, wherein the copolymer comprises from about 10 to about 25% by weight of units derived from said aromatic monomers.

The present invention also provides a thermal printing ink ribbon wherein said thermally meltable ink layer comprises an ester wax.

The present invention also provides a thermal printing ink ribbon wherein said copolymer is a styrene-based rubber copolymer.

The present invention also provides a thermal printing ink ribbon wherein said copolymer has an elongation of less than 1000% as calculated according to JIS K6301 by the following equation:

$$EB=\{(L_1-L_0)/L_0\}\times 100$$

wherein: EB=elongation (%), $L_0$=distance between bench marks (mm) on parallel portion of a dumbbell-shaped test piece for tension test in steady state, $L_1$=distance between the bench marks (mm) on the test piece at breakage under load.

The present invention also provides a thermal printing ink ribbon wherein said release layer has a thickness of 0.5 $\mu$m to 3.0 $\mu$m.

The present invention was made on the basis of the following findings:

At first, the release layer should comprise a predominant amount of an ester wax having a low solubility for the coating solvent so that the release layer may not be dissolved in the solvent contained in the ink solution.

Secondly, a small amount of a polymer should be added to increase the viscosity of the release layer itself and to prevent it from mixing with the ink layer.

Generally, polymers are more soluble than waxes in the solvent contained in the ink solution. Thus, the solubility of the whole release layer tends to be improved by adding a polymer. The inventors found that this tendency is pronounced when the wax and the polymer are well compatible with each other.

The inventors also found that it is difficult to form a release layer if the wax and the polymer are wholly incompatible.

Therefore, the present invention proposes a release layer comprising a predominant amount of an enter wax and a small amount of a rubber copolymer containing a specified weight percentage of units derived from aromatic monomers less compatible with the ester wax so that the ester wax and the copolymer are not totally compatible.

This release layer can not mix with the ink layer because it is less dissolved in the solvent of the ink solution during the coating process while the whole release layer improves its viscosity. Therefore, the boundary between the release layer and the ink layer is clear and the release layer maintains a certain thickness, whereby the transferability of the ink layer can be improved.

Even if the ester wax is also contained in the ink layer, it is less compatible with the copolymer in the release layer. Therefore, both can be prevented from mixing with each other even after storage in high-temperature environment.

According to the present invention, a high-quality transferability can also be obtained even at high printing speed by limiting the elongation of the copolymer to a specific value or less to decrease the adhesion of the release layer itself.

Moreover, the ink ribbon can be provided with a good transferability for use in so-called end face head-type thermal printers by limiting the thickness of the release layer within a specific range.

Numeral references represent the following elements: 1: thermal printing ink ribbon; 2: heat-resistant base; 3: release layer; 4: ink layer; 5: undercoat layer; 6: heat-resistant lubricant layer.

DETAILED DESCRIPTION OF THE INVENTION

Figure 1:
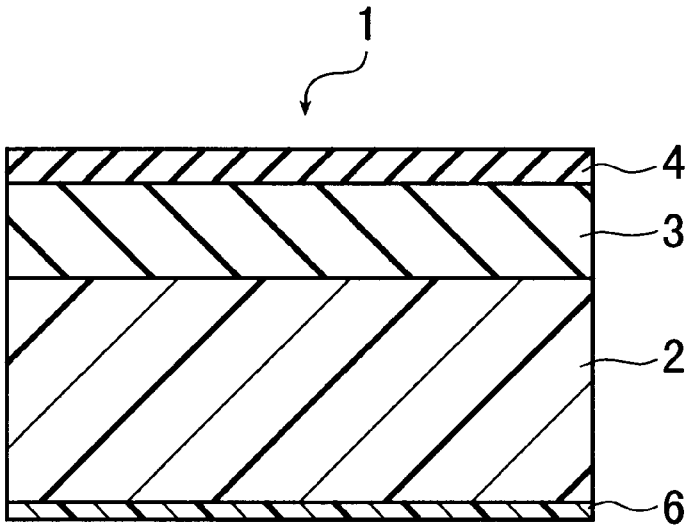
FIG. 1 is a cross-sectional view of a thermal printing ink ribbon of the present invention.

As shown in FIG. 1, the thermal printing ink ribbon 1 of the present invention comprises a heat-resistant base 2, a release layer 3 and a thermally meltable ink layer 4.

The heat-resistant base 2 of the present invention may be formed from a known plastic film, such as polyester films, polycarbonate films, nylon films, polyimide films, etc.

Among them, polyester films may preferably be used because they are highly resistant to heat and inexpensive. The thickness of the base is not critical, but ranges from 2 to 15 $\mu$m, generally 3 to 10 $\mu$m.

The release layer 3 of the present invention is comprising a predominant amount of an ester wax and further comprises a copolymer containing an aromatic monomer at a specific ratio.

The ester wax of the present invention specifically includes carnauba wax, rice wax, candelilla wax, etc.

The ester wax of the present invention may not be limited to those taxonomically called as wax, but also includes any thermally meltable material having an ester skeleton and a molecular weight of 10,000 or less provided that it has substantially similar properties to those of waxes.

For example, fatty acid esters such as alcohol fatty acid esters, glycol fatty acid esters, sorbitan fatty acid esters, etc. may be used.

Among these ester waxes, carnauba wax may preferably be used because it shows a low solubility of 5% or less for toluene which is usually used as the solvent for applying an ink composition by the solvent process or hot-solvent process (see "Properties of waxes and their application" by Kenzo Fusegawa, published by Sachi Shobo) to avoid mixing of the ink solution and the release layer 3.

It is also possible to use other waxes such as paraffin wax, microcrystalline wax, and polyethylene wax within the scope of the objects of the present invention.

In the release layer 3 of the present invention, a rubber copolymer containing from about 10 to about 25% by weight of units derived from aromatic monomers is used, wherein the aromatic monomer units are generally less compatible with the above-mentioned ester wax.

The aromatic monomer component of the present invention specifically includes styrene, vinyl toluene, methyl styrene, xylene, phenol, cumene, etc., while the other monomer component specifically includes acrylic monomers such as (meth) acrylic acid, (meth)acrylic acid ester, etc.; or rubber-based monomers such as ethylene, butadiene, isoprene, butylene, etc.

If the other monomer component is less compatible with the ester wax than the aromatic monomer component, the copolymer of these two components would be wholly incompatible with the ester wax to lower the stability of the solution during formation of the release layer 3. Thus, the other component is preferably a rubber-based monomer which has a relatively high compatibility with the ester wax.

Among those copolymers, therefore, styrene-rubber copolymers such as styrene-isoprene-styrene (abbreviated as SIS), styrene-butadiene-styrene (abbreviated as SBS), styrene-ethylene-butadiene-styrene (abbreviated as SEBS), styrene-ethylene-propylene-styrene (abbreviated as SEPS), etc. may preferably be used.

It is unpreferable that the amount of units derived from aromatic monomers not be below about 10% by weight, because such a copolymer tends to be compatible with the ester wax. A weight percent exceeding 25% by weight is also unpreferable because it tends to increase the solubility of the copolymer in the solvent of the ink solution.

In the present invention, the weight ratio of the ester wax to the copolymer present in the release layer is generally from about 98:2 to about 70:30.

The above copolymer preferably has an elongation of 1000% or less as calculated according to JIS K6301 by the following equation:

$$EB=\{(L_1-L_0)/L_0\}\times 100$$

wherein: EB=elongation (%), $L_0$=distance between bench marks (mm) on parallel portion of a dumbell-shaped test piece for tension test in steady state, $L_1$=distance between the bench marks (mm) on the test piece at breakage under load.

Beyond this range, the release layer 3 tends to be adherent to decrease the transferability at high printing speed.

The release layer 3 of the present invention may incorporate other resins such as ethylene-vinyl acetate copolymers, ethylene-acryl copolymers, polyamide resins, acrylic rubbers, butyl rubbers, isoprene rubbers, etc. within the scope of the objects of the present invention.

Figure 2:
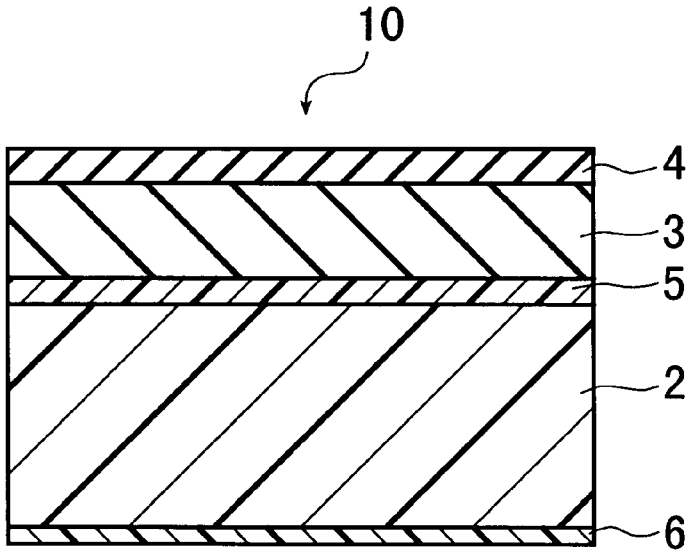
FIG. 2 is a cross-sectional view of a thermal printing ink ribbon according to another embodiment of the present invention.
Figure 3:
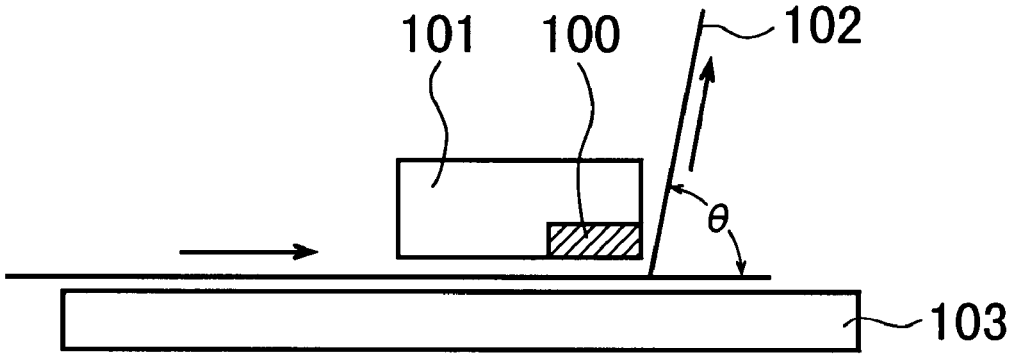
FIG. 3 illustrates a manner of transfer using a thermal printing ink ribbon in an end face head-type printer.

An shown in FIG. 2, the thermal printing ink ribbon of the present invention may optionally comprise an undercoat layer 5 between the base and the release layer 3 to improve the adhesion between the base and the release layer 3 at rest.

The undercoat layer 5 may be formed from polyester resins, polyurethane resins, polyamide resins, etc.

The ink layer of the present invention comprises known colorant and binder material.

The colorant may include dyes, pigments, carbon and fillers, while the binder material may specifically include waxes such as carnauba wax, candelilla wax, rice wax, wood wax, jojoba oil, bee wax, etc.; and thermoplastic resins such as ethylene-vinyl acetate copolymers, polyesters, vinyl chloride, polyurethanes, etc.

The release layer 3 and the ink layer of the present invention described above can be formed on the base by dissolving and/or dispersing these compositions in a solvent to prepare a solution and applying it by a known means such as gravure coater, roll coater, knife coater, curtain coater, etc.

The thickness of the release layer 3 of the present invention is generally 0.5 μm to 4.0 μm, but preferably 1.0 μm to 3.0 μm for use in end face head-type printers.

The thickness of the ink layer is generally 0.3 μm to 4.0 μm, but preferably 0.3 μm to 2.0 μm for use in end face head-type printers. In end face head-type printers, the thickness of the release layer 3 is preferably greater than the thickness of the ink layer in order to smooth the transfer.

According to the present invention, a heat-resistant lubricant layer 6 may be provided on the surface of the reverse side of the surface of the base comprising the ink layer, for the purpose of stabilizing the travelling behavior, as shown in FIG. 1 and 2.

The heat-resistant lubricant layer 6 may consist of a lubricant resin such as silicone resins or fluorine resins in a coating amount of 0.01 to 0.5 g/m$^2$.

This invention will now be described in detail by way of examples.

EXAMPLES

Example 1

Preparation of a Thermal Printing Ink Ribbon

Formation of a Heat-resistant Lubricant Layer

The following composition was dissolved in a mixed solvent of toluene and M.E.K. and applied on the surface of a polyester film of 5.0 μm as a base using a fountain unit attached to a gravure coater:

| | parts by weight |
|---|---|
| Acryl-silicone graft resin (US380, Toagosei Co., Ltd.) | 60 |
| Isocyanate (Takenate D110N, Takeda Chemical Industry, Ltd.). | 40 |

The coating amount after drying was 0.1 g/m$^2$.

Formation of an Undercoat Layer

A polyester resin (Bylon #200, Toyobo Co., Ltd.) was dissolved in a mixed solvent of toluene and M.E.K. and applied on the opposite surface to the heat-resistant lubricant layer using a gravure unit attached to a gravure coater.

The coating thickness after drying was 0.5 μm.

Formation of a Release Layer

The following composition was dissolved under heat in toluene and applied on said undercoat layer using a gravure unit attached to a gravure coater:

| | parts by weight |
|---|---|
| Styrene-based rubber copolymer (SEBS) (Taftec H1052, Asahi Chemical Industry Co., Ltd.) | 20 |
| Carnauba wax (Carnauba No. 2, Kato Yoko, Corp.) | 80 |

This styrene-based rubber copolymer has a styrene monomer content of about 20% by weight and an elongation of 700% as calculated according to JIS K6301.

The coating thickness after drying was 2.5 μm.

Formation of an Ink Layer

The following composition was dissolved under heat in toluene and applied on said release layer using a gravure unit attached to a gravure coater:

| | parts by weight |
|---|---|
| Carbon black | 20 |
| Carnauba wax (Carnauba No.2, Kato Yoko, Corp.) | 6 |
| Candelilla wax (Purified candelilla wax, Noda Wax, Corp.) | 14 |
| Ethylene-vinyl acetate copolymer (Ultracene 725, Tosoh Corp.) | 20 |
| Styrene-based oligomer (FTR8100, Mitsui Petrochemical Industries, Ltd.) | 20 |
| Styrene-based rubber copolymer (Quinton 401CS, Shell Japan Co.) | 20 |

The coating thickness after drying was 1.5 μm.

Evaluation Method

The thermal printing ink ribbon prepared by the procedure described above was evaluated according to the following evaluation method.

Transferability Evaluation

Solid pattern images were formed by a printer using the thermal printing ink ribbon prepared as described above and visually observed.

The printing conditions involved both of an ordinary printing speed of 3 inch/sec. and a high printing speed of 8 inch/sec. using an end face head-type thermal printer (B572, TEC, Corp.).

The label used was rough paper (Belam made by Stylo Corp.) having a smoothness of about 200 as expressed as BEEK value.

In this evaluation, solid pattern images with good transferability showing no "blank" in which the ink layer has not been transferred were ranked as ○, those with visible blank but suitable for practical use were ranked as Δ, and those with significant blank to decrease the printing density were ranked as X.

Transferability After Storage in High-temperature Environment

After the thermal printing ink ribbon prepared as described above was allowed to stand in an incubator at 50° C. for a week, it was removed from the incubator and confirmed to have been cooled down to room temperature, then evaluated under the same conditions as those of the above transferability evaluation.

Results

The thermal printing ink ribbon of Example 1 could form good solid pattern images ranked as "○" without blank not only at ordinary printing speed but also at high printing speed.

It also could form good solid pattern images ranked as "○" without deteriorating the transferability even after storage in high-temperature environment.

The results are shown in Table 1.

Examples 2, 3 and Comparative Examples 1 to 4

Thermal printing ink ribbons of Example 2, 3 and Comparative examples 1 to 3 were prepared in the same manner as in Example 1 except that the component ratio of the aromatic monomer component to the release layer was changed as shown in Table 1. In Comparative example 4, a thermal printing ink ribbon was prepared in the same manner as in Example 1 except that an ethylene-vinyl acetate copolymer was used in place of the copolymer containing an aromatic monomer. These results are also shown in Table 1.

Results

Examples 2 and 3 could form solid pattern images ranked as "○" at ordinary printing speed and could form solid pattern images suitable for practical use ranked as "Δ" even at high printing speed. However, with example 3, decreasing the transferability deteriorated at high printing speed after storage in high-temperature environment was occurred.

Comparative examples 1 to 4 showed transferability unsuitable for practical use ranked as "X" at high printing speed.

The thermal printing ink ribbon of Comparative example 4 which does not contain any aromatic monomer component showed a transferability inferior to those of the other thermal printing ink ribbons even at ordinary printing speed.

TABLE 1

| | Copolymer | | Evaluation results | | | |
|---|---|---|---|---|---|---|
| | Aromatic monomer componen ratio | Elongation (%) | Transferability 3 in. | Transferability 8 in. | Transferability after storage 3 in. | Transferability after storage 8 in. |
| Ex. 1 | 20 | 700 | ○ | ○ | ○ | ○ |
| Ex. 2 | 21 | 1200 | ○ | Δ | ○ | Δ |
| Ex. 3 | 14*2 | 1300 | ○ | Δ | ○ | Δ |
| Comp. Ex. 1 | 40*3 | 600 | ○ | X | Δ | ○ |
| Comp. Ex. 2 | 30*4 | 1200 | ○ | X | — | — |
| Comp. Ex. 3 | 30*5 | 580 | ○ | X | — | — |
| Comp. Ex. 4 | EVA*6 | — | Δ | X | — | — |

*1Styrene-based rubber copolymer (SIS) (Quinton D1111, Shell Japan Co.)
*2Styrene-based rubber copolymer (SIS) (Kaliflex TR1107, Shell Japan Co.)
*3Styrene-based rubber copolymer (SEBS) (Taftec H1051, Asahi Chemical Industry Co., Ltd.)
*4Styrene-based rubber copolymer (SIS) (Clayton D1125, Shell Japan Co.)
*5Styrene-based rubber copolymer (SEPS) (Septon 2002, Kuraray Co. Ltd.)
*6Ethylene-vinyl acetate copolymer (EVA) (HE-10, Sumitomo Chemical Co., Ltd.)

Advantages of the Invention

As apparent from the foregoing description, the thermal printing ink ribbon of the present invention has a better transferability than prior ink ribbons and also has the advantage that the transferability is not lowered even at high printing speed. The present invention also has the advantage that the transferability is not lowered even in high-temperature environment. Moreover, the present invention can advantageously provide a well-suited transferability to an ink ribbon for use in so-called end face head-type thermal printers.

We claim:

1. A thermal printing ink ribbon comprising:

a heat resistant base having first and second opposing major surfaces;

a release layer disposed on said first major surface comprising an ester wax and a rubber copolymer comprising from about 10 to about 25% by weight of units derived from aromatic monomers; and a thermally meltable ink layer disposed on said release layer by a solvent process or a hot-solvent process.

2. A thermal printing ink ribbon according to claim 1, wherein said thermally meltable ink layer comprises an ester wax.

3. A thermal printing ink ribbon according to claim 1, wherein said copolymer is a styrene-based rubber copolymer.

4. A thermal printing ink ribbon according to claim 1, wherein said copolymer has an elongation of 1000% or less as calculated according to JIS K6301 by the following equation:

$$EB=\{(L_1-L_0)/L_0\}\times 100$$

wherein: EB=elongation (%), $L_0$=distance between bench marks (mm) on parallel portion of a dumbbell-shaped test piece for tension test in steady state, $L_1$=distance between the bench marks (mm) on the test piece at breakage under load.

5. A thermal printing ink ribbon according to claim 1, wherein said release layer has a thickness of 0.5 μm to 3.0 μm.

6. A thermal printing ink ribbon as defined in claim 1, wherein said heat-resistant base comprises a plastic film.

7. A thermal printing ink ribbon as defined in claim 1, wherein said heat-resistant base is selected from the group consisting of: polyester film, polycarbonate film, nylon film and polyimide film.

8. A thermal printing ink ribbon as defined in claim 1, wherein said copolymer comprises units derived from said aromatic monomers and units derived from other monomers, and said aromatic monomers are selected from the group consisting of: styrene, vinyl toluene, methyl styrene, xylene, phenol and cumene.

9. A thermal printing ink ribbon as defined in claim 1, wherein said copolymer comprises units derived from said aromatic monomers and units derived from other monomers, said other monomers are selected from the group consisting of: (meth)acrylic acid, (meth)acrylic acid esters, ethylene, propylene, butadiene, isoprene and butylene.

10. A thermal printing ink ribbon as defined in claim 1, wherein said copolymer comprises a copolymer selected from the group consisting of: styrene-isoprene-styrene copolymers, styrene-butadiene-styrene copolymers, styrene-ethylene-butadiene-styrene copolymers and styrene-ethylene-propylene-styrene copolymers.

11. A thermal printing ink ribbon as defined in claim 1, wherein said thermally meltable ink layer comprises a colorant and a binder.

12. A thermal printing ink ribbon as defined in claim 11, wherein said colorant is selected from dyes, pigments, carbon and fillers.

13. A thermal printing ink ribbon as defined in claim 11, wherein said binder comprises a wax or a thermoplastic resin.

14. A thermal printing ink ribbon as defined in claim 11, wherein said binder comprises a wax selected from the group consisting of: carnauba wax, candelilla wax, rice wax, wood wax, jojoba oil, bees wax and fatty acid esters.

15. A thermal printing ink ribbon as defined in claim 11, wherein said binder comprises a thermoplastic resin selected from the group consisting of: ethylene-vinyl acetate copolymers, polyesters, polyvinyl chlorides and polyurethanes.

16. A thermal printing ink ribbon as defined in claim 1, wherein the weight ratio of said ester wax to said rubber copolymer is from about 98:2 to about 70:30.

17. A thermal printing ink ribbon as defined in claim 1, further comprising an undercoat layer disposed intermediate the first surface of the heat-resistant base and said release layer.

18. A thermal printing ink ribbon as defined in claim 17, wherein said undercoat layer comprises polyester resin, polyurethane resin or polyamide resin.

19. A thermal printing ink ribbon as defined in claim 1, further comprising a heat-resistant lubricant layer disposed on said second major surface of the heat-resistant base.

20. A thermal printing ink ribbon as defined in claim 19, wherein said heat-resistant lubricant layer comprises a lubricant resin selected from the group consisting of: silicone resins and fluorine resins.

* * * * *